United States Patent [19]

Warnock

[11] 4,207,796

[45] Jun. 17, 1980

[54] ORDNANCE INDUCTION FIRING SYSTEM

[75] Inventor: Frederick E. Warnock, Silver Spring, Md.

[73] Assignee: The United States of America as represented by the Secretary of the Navy, Washington, D.C.

[21] Appl. No.: 481,428

[22] Filed: Jun. 20, 1974

[51] Int. Cl.[2] ..... F42B 9/08

[52] U.S. Cl. ..... 89/28 R; 102/46

[58] Field of Search ..... 89/1.5 D, 1.814, 28 R, 89/28; 102/28 R, 28 S, 46, 70.2 G, 202, 203

[56] References Cited

U.S. PATENT DOCUMENTS

| | | | |
|---|---|---|---|
| 2,421,752 | 6/1947 | Jones | 89/1.816 |
| 2,459,854 | 1/1949 | Swift | 89/28 R |
| 2,640,417 | 6/1953 | Bjork et al. | 89/1.814 |
| 3,038,384 | 6/1962 | Gaugler | 89/28 R |
| 3,185,093 | 5/1965 | Holinbeck | 102/28 R |
| 3,211,057 | 10/1965 | White et al. | 89/1.5 D |
| 3,229,582 | 1/1966 | Schlie | 102/70.2 G |
| 3,667,342 | 6/1972 | Warnock | 89/1.5 D |
| 3,728,935 | 4/1973 | Magorian | 89/1.814 |
| 3,809,964 | 5/1974 | Ceyrat | 102/46 |

*Primary Examiner*—Stephen C. Bentley

*Attorney, Agent, or Firm*—R. S. Sciascia; A. L. Branning; R. E. Bushnell

[57] ABSTRACT

An apparatus for igniting a squib attached to the base of an ordnance round through a two part inductive type of device having one part that is attached to the base of the ordnance round and axially insertable into a second part which is mounted at the bottom of a launching tube. The two parts are inductively coupled via an air gap.

9 Claims, 7 Drawing Figures

ORDNANCE INDUCTION FIRING SYSTEM

BACKGROUND OF THE DISCLOSURE

The present invention relates generally to ordnance devices and more specifically to electrical induction firing systems for ordnance devices.

Various problems have existed for launching ordnance rounds. A common method used in the prior art was to perfect an electrical connection between the ordnance round and the launcher to introduce an electrical signal to the ordnance round to cause it to be launched. Other prior art devices relied upon relative motion (i.e., Lenz's law) between an energized circuit of a magnetic transducer mounted in the launching apparatus and a detonator transducer mounted in the ordnance round. An example of such a device is disclosed by the present inventor in Warnock, et al, U.S. Pat. No. 3,667,342, Magnetic Weapon Transducer Link. A third category of prior art ordnance firing devices uses a transformer having a primary winding mounted on a launcher and closely coupled to a secondary winding wound around an ordnance round. Such a device is disclosed in Gaugler, U.S. Pat. No. 3,038,384, Induction Firing Device for a Rocket Motor.

Another disadvantage in prior art firing devices is the hazard of accidental firing due to extraneous electrical or electromagnetic sources, such as lightning and static electricity or radio wave and radar propagation, respectively. With a trend toward greater effective radiated power in communication systems and radar, electromagnetic radiation has posed an increasing danger of accidental firing.

SUMMARY OF THE INVENTION

The present invention overcomes the disadvantages and limitations of the prior art by providing a stationary induction ordnance firing system. A shielded load core of a magnetizable material containing a toroid load wire coil across which a low impedance, electro-explosive detonator is connected, is placed adjacent to but separated by an air gap from a corresponding toroidal primary wire coil contained in a shielded excitation core. A shielded load core containing a load wire coil across which a low impedance electro-explosive detonator is connected, is placed inside and adjacent to, but separated by an air gap from a corresponding primary wire coil contained in a shielded excitation assembly the inductive coupling system allows the ordnance round to contain an electrically initiated detonator which fires or launches the ordnance without direct electrical connection to the launcher sudden introduction or removal of current through the excitation coil induces a current into the load coil of greater but delayed peak power due to the rapid change in the magnetic flux. In addition, elimination of the necessity for relative movement between the launcher and the ordnance round allows the round to be fired remotely.

It is therefore an object of the present invention to provide an improved ordnance launch initiation system.

It is also an object of the present invention to provide an ordnance launch initiation system which is reliable in operation.

Another object of the present invention is to provide an ordnance launch initiation system that is safe to operate due to its certainty of firing.

Another object of the present invention is to provide an ordnance launch initiation system which protects against electrical and electromagnetic radiation which might cause an unintended firing.

Another object of the present invention is to provide an inductively coupled ordnance launch initiation system which can be fired from a remote location.

Other objects, advantages and novel features of the invention will become apparent from the following detailed description of the invention when considered in conjunction with the accompanying drawings wherein:

DETAILED DESCRIPTION OF THE PREFERRED EMBODIMENT

Figure 1:
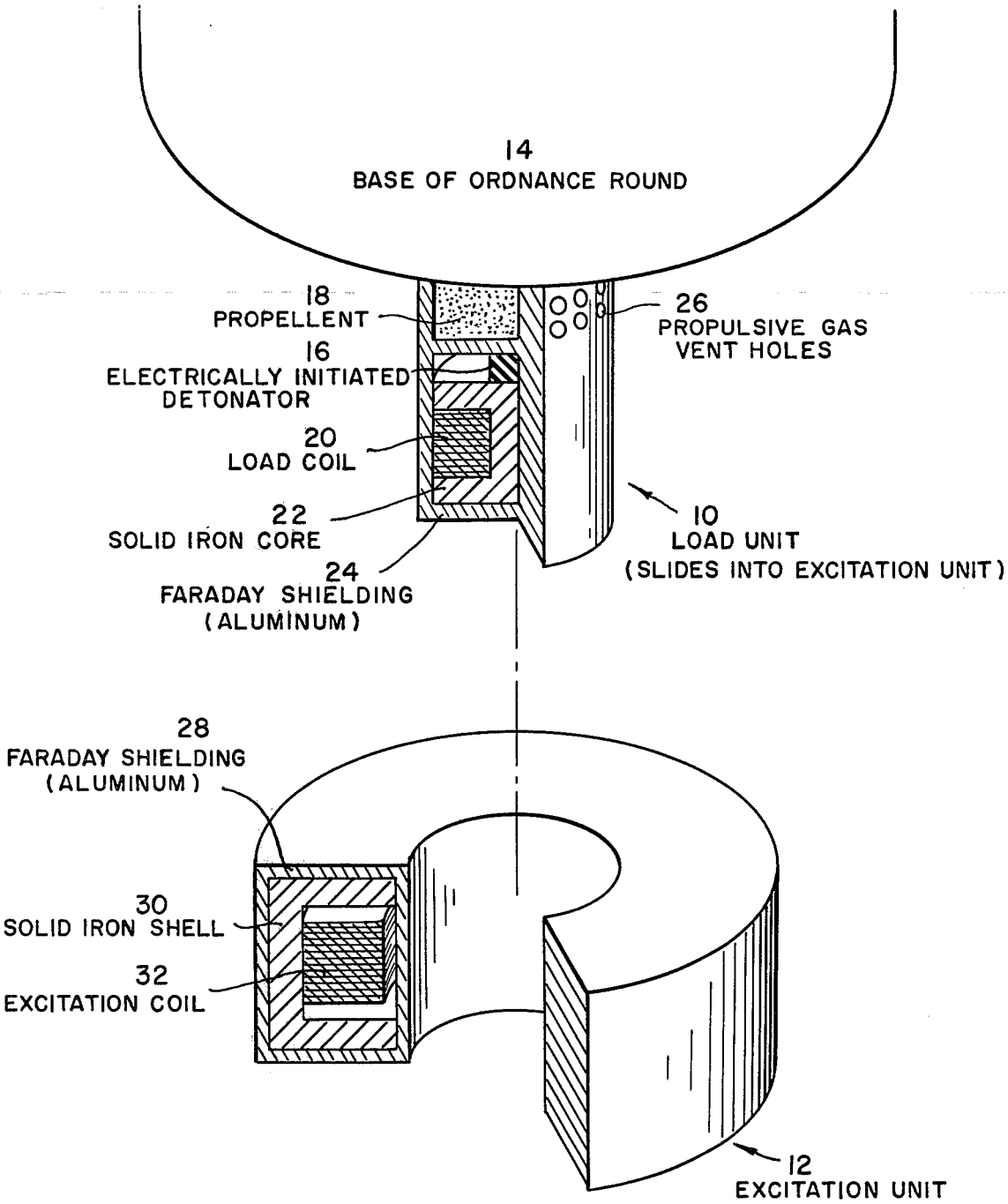
FIG. 1 is a perspective sectional view showing one preferred embodiment of the invention.

FIG. 1 shows a basic configuration for an induction firing system comprising the preferred embodiment. The system comprises a cylindrical load unit 10 axially insertable into the cavity of the primary assembly excitation unit 12 attached to the ordnance round 14 and launching tube (not shown), respectively.

Figure 3:
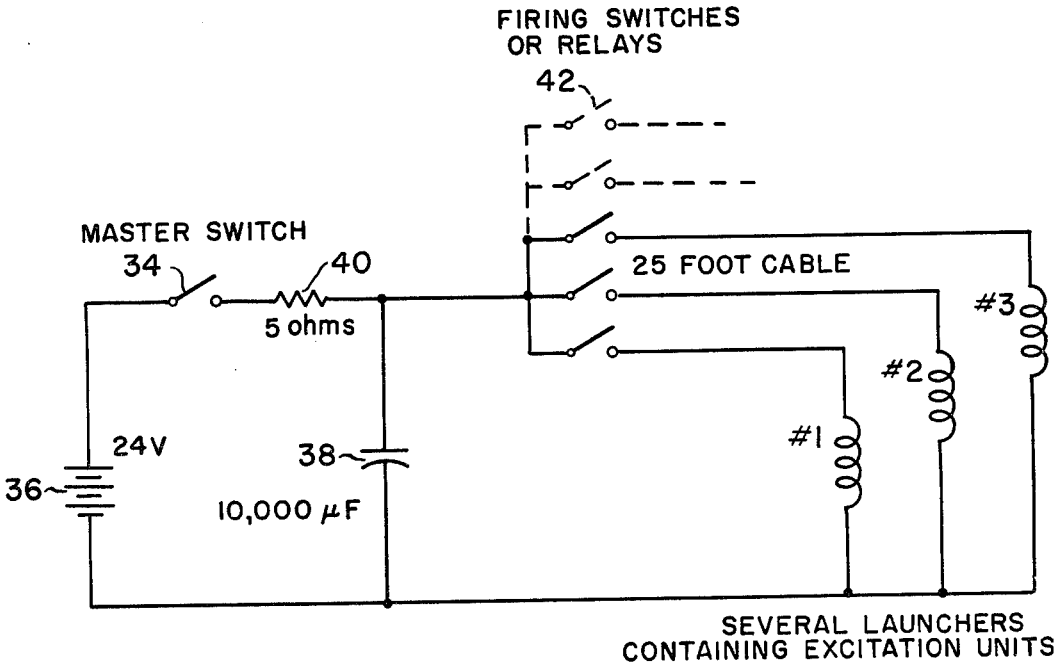
FIG. 3 is a schematic diagram showing a typical capacitive discharge system for energizing the excitation units.

The load unit is electrically connected to the electrically initiated detonator 16 used to fire the round 14. In operation, the round 14 is placed in the launching tube where the load unit 10 comes in close proximity to the excitation unit 12. As shown in FIG. 1, the load unit is axially inserted into the excitation unit. The firing signal applied to the excitation coil 32 is a direct current pulse produced by the capacitive discharge system shown in FIG. 3. The current pulse travels through the primary or excitation coil 32 so as to produce a magnetic field having a high magnetic flux density in the solid iron shell 30 of the excitation unit 12, solid iron core 22 of the load unit 10, and the airgap between the two units. The rapidly changing flux in iron shell 30 develops a moderate amplitude current pulse in load coil 20 of moderate duration due to the flux coupling between the units. The peak power delivered to the load or secondary coil 20, and thus to the detonator 16, is directly proportional to the square of the reluctance of the air gap 52 and the square of the magnetic flux in the load assembly 10. Rapid open circuiting of the excitation coil 32 by opening the respective firing switch 42 after the flux in iron core 22 has reached its maximum value causes the energy stored in the airgap to be discharged into the load unit 10, developing a short, high amplitude de-excitation pulse in load coil 20. The total energy delivered to the load or secondary coil is directly proportional to the reluctance of the air gap 52 and the square of the magnetic flux in the load assembly 10. If the iron cores 22, 30, are worked at the knee of the magnetization curve (i.e., the point of maximum permeability), this specifies the total flux for a given excitation and load assembly geometry. Both the power and total energy delivered to the load coil 20 may be directly varied by varying the difference between the diameters of cylindrical load assembly 10 and the inner diameter of the excitation assembly 12; however, a peak power and a maximum energy transfer will not usually coincide at the same difference of diameters.

The induction firing system may be optimized to use either the "excitation" or "de-excitation" output pulse. The de-excitation pulse will generally have a higher peak power and total energy output if driven from a DC power-limited source. If the source is energy-limited, the excitation pulse may well have the higher effective output, particularly for insensitive type detonators having a thermal time constant in the same order of magnitude as the expected rise and fall times of the induced current pulse. Effective output depends both on output pulse shape and the thermal characteristics of the electrically initiated detonator. The short de-excitation pulse from a magnetically saturated iron core will generally be a better match to a low energy, quick acting detonator. A very large alignment tolerance of the load unit with respect to the axial cavity of the excitation unit 12 is allowable. Due to the symmetrical configuration and the large air gap between the load and excitation units 10, 12, moving the load unit off center (i.e., an eccentrically axial insertion of the ordnance round 14 to which the load unit is attached) until their surfaces touch along one side and the air gap is doubled along the opposite side causes little change in the peak value or shape of the output wave in the load coil.

The load coil 20 is connected to the electrically initiated detonator 16 which is activated by the pulse produced to ignite the propellant 18. Upon ignition, propellant 18 is expelled through propulsive gas vent holes 26.

Protection from both electrical and electromagnetic radiation results from several features of the invention. Since both the load and excitation units are contained within an aluminum Faraday shield 24, both the excitation coil 32 and load coil 20 are protected from radiation. In addition, the solid iron construction of both the excitation and load units 12-10 causes large eddy current losses to any stray alternating or radio frequency currents or magnetic fields. Also, the design of the present invention precludes stray firings since it is very difficult to achieve a flux density in iron high enough to fire the ordnance except with the special configuration of the excitation unit. Similarly, as embodiments constructed according to the invention are designated to operate with magnetically saturated cores, the power level required to magnetically saturate the induction firing system is large, and the impedance of the detonators are small, typically on the order of one ohm, stray fields are thereby unable to effectively couple into either the excitation or load units. Also, since high energies are used for coupling, relatively less sensitive and therefore safer detonators can be used with the device.

Figure 2:
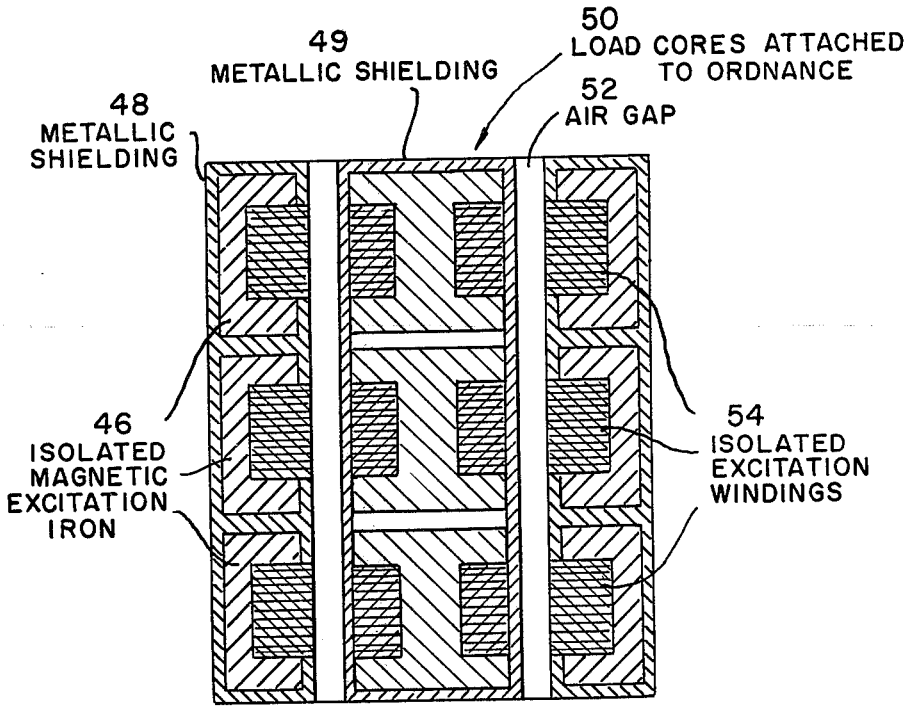
FIG. 2 is a cross-section view showing an alternative embodiment.

FIG. 2 is a cross section of axially symmetric excitation and load units containing three isolated excitation cores 46 and three isolated load cores 50, respectively. The units are shown assembled ready for induction firing. All excitation cores are within a common metallic Faraday shield 48. All load cores are within a common metallic Faraday shield 49. The function of the shields are the same as those functions given above. The advantage of having three or more separate cores is that distinct bits of information can be transmitted to the remote firing device upon firing.

Figure 4:
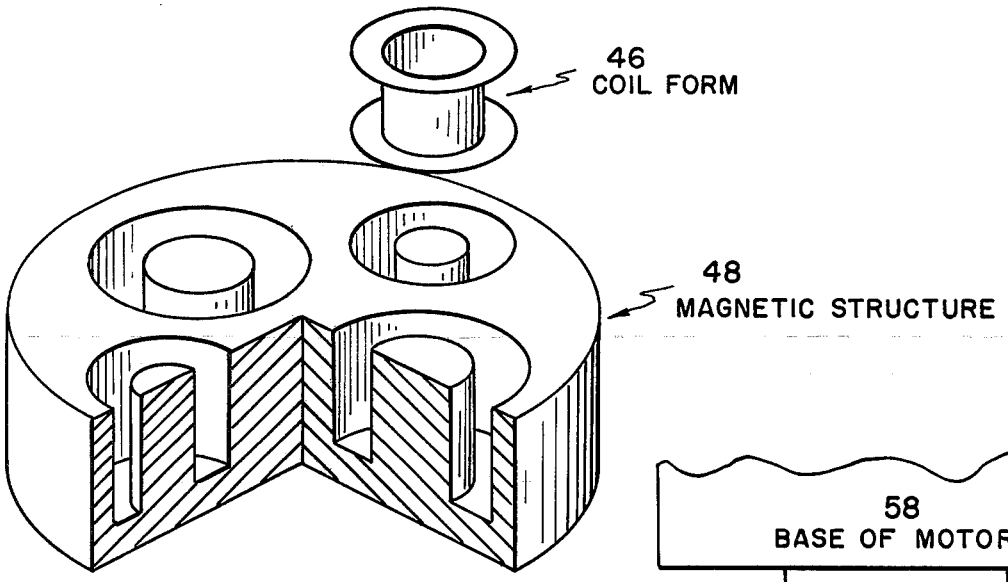
FIG. 4 is a perspective sectional view showing an alternative embodiment using a four core planar structure.
Figure 5:
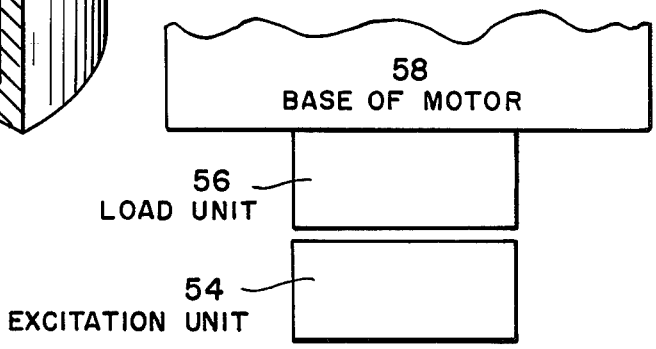
FIG. 5 is a front view of an alternative embodiment using a concentric planar structure of cores.

An alternative embodiment is shown in FIG. 4 comprising a four core planar nonconcentric structure. The magnetic structure 48 is adapted to receive four wire coil forms 46. Identical structures are used for both the excitation and load units arranged in the manner shown in FIG. 5. Magnetic flux lines emanate vertically from the magnetic structure of the excitation unit 54 to the magnetic structure of the load unit 56. Although the ordnance round requires circular orientation upon insertion in the launching tube to achieve proper flux coupling, less volume is required for the configuration of FIG. 4 both in the base of the launcher and at the end of the round. A reduction in volume is often critical when considering the aerodynamics of the ordnance round and other space and weight considerations.

Figure 6:
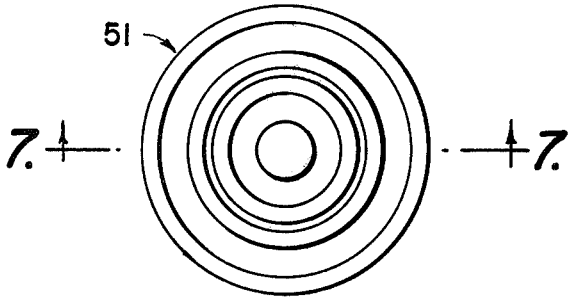
FIG. 6 is a top view of the embodiment shown in FIG. 5.
Figure 7:
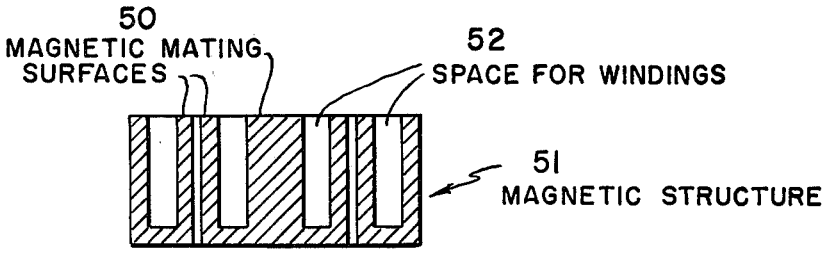
FIG. 7 is a cross-section view taken from FIG. 6.

An additional alternative embodiment is shown in FIGS. 6 and 7. FIG. 6 is a top view of the magnetic structures used for both the excitation unit 54 and the load unit 56 shown in FIG. 5. FIG. 7 is the cross section view of a single magnetic structure as shown in FIG. 6. The magnetic structure 51 is a two core concentric planar structure requiring two concentric windings for both the load and excitation units. This alternative has all the advantages of the magnetic structure 48 of FIG. 4 without requiring circular orientation during loading.

The system thus provides a simple, safe, and reliable means of launching ordnance devices without the use of electrical connectors, which can be used in a battle environment in the field or from ship deck requiring no physical movement in the launcher or ordnance round and providing remote launch control.

Obviously many modifications and variations of the present invention are possible in light of the above teachings. For example, a simultaneous, sequential or separate means for exciting one or more of the excitation cores in either of two magnetization polarities can be provided. In addition, each excitation or load core may be shielded independently or contained within a common shield. Shielding can consist of continuous electrically conductive shields such as aluminum, stainless steel, copper, etc., or of solid iron, mild steel or other magnetic materials for electrical, magnetic, and electro-magnetic shielding. The peak power and the energy induced into the load assembly are directly proportional to the reluctance of the air gap, and therefore, the difference between the interior diameter of the cylindrical load assembly. Although embodiments having a difference in diameters as small as 0.05 inches will begin to function as induction devices according to the teachings of the invention, it is preferable to have a minimum difference of approximately 0.3 inches. The difference in diameters must be large enough to generate significant self-inductance in both the excitation and load cores, and yet small enough to have significant mutual inductance between the excitation and load cores. The air gap caused by a difference in excitation assembly interior and load assembly exterior diameters is usually occupied by air but may, without impairment of the operation, be filled with any material having a low conductivity and a low permeability in comparison to iron (e.g., sea water, sand, or mud). It is therefore to be understood that within the scope of the appended claims the invention may be practiced otherwise than as specifically described.

What is claimed as new and desired to be secured by Letters Patent of the United States is:

1. An ordnance induction firing device disposed about the base of a projectile of the type launched from a tube, comprising:

excitation means mounted inside the tube, comprising:

an excitation coil;

a solid excitation shell of a magnetic material surrounding all but the interior circumferential surface of the excitation coil; and a first metallic shield enclosing the excitation means;

load means external to but associated with the base of the projectile, slidably positionable inside and adjacent to but separated by an air gap from said excitation means, for detecting the magnetic flux produced by the excitation means and providing an electric current upon rapid change of said magnetic flux, comprising:

a solid load core of a magnetic material;

a load coil wound about the solid load core;

a squib coupled across the load coil;

a propellant for causing the removal of the load means from inside the excitation means, disposed about the squib; and a second metallic shield completely enclosing the load means, the squib, and the propellant.

2. A stationary induction firing system for an ordnance round, comprising:

excitation means, comprising:

an excitation coil having an interior circumferential surface adjoining opposed exterior surfaces, having an exterior diameter less than the greatest exterior diameter of the ordnance round;

a solid excitation shell of magnetic material coaxially disposed adjacent the opposed exterior surfaces, surrounding all but the interior circumferential surface of the excitation coil;

a Faraday shield clothing the exposed surfaces of the shell and the excitation coil;

for producing a magnetic flux in response to an electric current in the excitation coil;

load means eccentrically axially insertable into the excitation means, for detecting the magnetic flux produced by the excitation means and providing an electrical signal upon rapid change in the magnetic flux, comprising:

a solid core proximately positionable adjacent to but separated by an air gap from the interior circumferential surface of the excitation shell; and a load coil wound about the solid core.

3. A stationary induction firing system for an ordnance round, comprising:

excitation means, comprising:

an excitation coil having an interior circumferential surface adjoining opposed exterior surfaces, having an exterior diameter less than the greatest exterior diameter of the ordnance round;

a solid excitation shell coaxially disposed adjacent the opposed exterior surfaces;

for producing a magnetic flux in response to an electric current in the excitation coil;

load means eccentrically axially insertable into the excitation means for detecting the magnetic flux produced by the excitation means and providing an electrical signal upon rapid change in the magnetic flux, comprising:

a solid core of a magnetic material proximately positionable adjacent to but separated by an air gap from the interior circumferential surface of the excitation core;

a load coil wound about the solid core with all but an exterior circumferential surface of the load coil surrounded by the solid core;

a squib coupled across the load coil; and a Faraday shield completely clothing the load means.

4. The system of claim 2 wherein said load means comprises a solid core of a non-permanent magnetic material surrounding all but the exterior circumferential surface of said load coil, a squib coupled across the load core, and a Faraday shield completely clothing the load means.

5. A stationary induction firing system for an ordnance round, comprising:

excitation means, comprising:

more than one excitation coil, each coil having an interior circumferential surface adjoining opposed exterior surfaces, and an exterior diameter less than the greatest exterior diameter of the ordnance round;

an equal number of solid excitation shells of a magnetic material, each shell containing and coaxially disposed adjacent the opposed exterior surfaces of a different excitation coil;

for producing a magnetic flux in response to an electric current in an excitation coil;

load means equal in number to the number of excitation means, for detecting the magnetic flux produced by the excitation means and providing an electrical signal upon rapid change in the magnetic flux, comprising:

solid cores of magnetic material;

load coils each wound about a different one of the solid cores;

whereby after the load means is at rest inside the excitation means, the exterior circumferential surface of each load core is adjacent to and separated by an air gap from the interior circumferential surface of the corresponding excitation shell.

6. The system of claim 5 wherein said cores are arranged in an axially symmetric configuration.

7. The system of claim 5 wherein said cores are arranged in a planar axially concentric configuration.

8. The system of claim 5 wherein said load means includes a squib and said excitation means and said load means are individually and completely clad in Faraday shields.

9. A stationary ordnance induction firing device disposed about the base of an ordnance round, comprising:

excitation means including an excitation coil for producing a magnetic flux in response to an electric current in the excitation coil;

the excitation coil having a greatest diameter less than the greatest exterior diameter of the ordnance round;

a solid excitation core of a non-permanent magnetic material surrounding all but the interior circumferential surface of the excitation coil; and, load means external to but associated with the base of the ordnance round, including a load coil wound about a solid load core of a non-permanent magnetic material, proximately positionable inside and adjacent to but separated by an air gap from said excitation means, for detecting said magnetic flux produced by said excitation means and providing an electric current upon rapid change of said magnetic flux.

* * * * *